US005579832A

United States Patent [19]

Le Gauyer

[11] Patent Number: 5,579,832

[45] Date of Patent: Dec. 3, 1996

[54] HEAT EXCHANGER TUBE, APPARATUS FOR FORMING SUCH A TUBE, AND A HEAT EXCHANGER COMPRISING SUCH TUBES

[75] Inventor: Philippe Le Gauyer, Paris, France

[73] Assignee: Valeo Thermique Moteur, Le Mesnil-Saint-Denis, France

[21] Appl. No.: 375,426

[22] Filed: Jan. 18, 1995

[30] Foreign Application Priority Data

Jan. 20, 1994 [FR] France ..... 94 00595

[51] Int. Cl.[6] ..... F28F 1/10

[52] U.S. Cl. ..... 165/173; 165/175

[58] Field of Search ..... 165/175, 173, 165/172, 153

[56] References Cited

U.S. PATENT DOCUMENTS

| | | | |
|---|---|---|---|
| 4,546,824 | 10/1985 | Melnyk | 165/153 |
| 4,730,669 | 3/1988 | Beasley et al. | 165/173 X |
| 5,099,576 | 3/1992 | Shinmura | 165/173 X |
| 5,174,372 | 12/1992 | Potier et al. | 165/173 |
| 5,219,024 | 6/1993 | Potier | 165/173 |

FOREIGN PATENT DOCUMENTS

| | | | |
|---|---|---|---|
| 0253167 | 1/1988 | European Pat. Off. . | |
| 914783 | 10/1946 | France . | |
| 2474674 | 7/1981 | France . | |
| 2674322 | 9/1992 | France . | |
| 2144465 | 3/1973 | Germany | 165/172 |
| 0095190 | 6/1983 | Japan | 165/175 |
| 1232414 | 5/1971 | United Kingdom | 165/173 |

OTHER PUBLICATIONS

French Search Report dated 17 Oct. 1994.

*Primary Examiner*—John Rivell
*Assistant Examiner*—Christopher Atkinson
*Attorney, Agent, or Firm*—Morgan & Finnegan, LLP

[57] ABSTRACT

A heat exchanger tube, especially for a motor vehicle cooling radiator, comprises a body of oblong cross section defined by two major faces and two minor faces, an end portion of oblong cross section, again defined by two major faces and two minor faces, and a transition portion which joins the tube body to its end portion. The transition portion has two inclined faces which join together the major faces of the tube body and the major faces of the end portion, together with at least one curved face which joins together a minor face of the tube body and a minor face of the end portion, while also joining together the two major faces of the tube body.

4 Claims, 4 Drawing Sheets

HEAT EXCHANGER TUBE, APPARATUS FOR FORMING SUCH A TUBE, AND A HEAT EXCHANGER COMPRISING SUCH TUBES

FIELD OF THE INVENTION

This invention relates to a heat exchanger tube, in particular for a motor vehicle, to methods and apparatus for forming such tubes, and to heat exchangers which include such tubes.

BACKGROUND OF THE INVENTION

It is known, in particular from French patent application 91 03412, to provide a heat exchanger tube comprising: a tube body having an oblong cross section defined by two major faces and two minor faces; an end portion of oblong cross section defined by two major faces and two minor faces; and a transition portion joining the tube body and end portion together, with the cross section of the tube body having a length and a width which are respectively greater and less than the length and width, respectively, of the cross section of the end portion.

In tubes of that type, the major faces of the body and end portion may be flat or slightly curved, while the minor faces of the tube body and those of the end portion are generally semicircular or even flat, in which case this flat minor face is joined to the two major faces through two rounded portions having a small radius of curvature. These tubes are arranged in a conventional way so as to form a tube bundle which is provided with fins, and over which a stream of air is passed. The oblong form of the tube bodies facilitates the flow of this air and reduces energy losses, by comparison with conventional heat exchangers having round tubes.

The cross section of the end portion of each tube is less oblong than that of the associated tube body, so as to facilitate the fitting of the tube end portion on to a header plate, or "perforated plate", through which the tube end portions are inserted.

In the heat exchanger described in the above mentioned French patent application, the tubes may be disposed in pairs and in two rows, with the end portions of the tubes of a pair being received in a common hole in the header plate. This particular arrangement enables a more compact configuration of the heat exchanger to be achieved, especially widthwise, because the tubes are abutted together in pairs instead of being separated from each other as in previous arrangements.

One of the problems posed by the arrangement of tubes of the kind just described is that of how to configure, or work, them to the required form, especially as regards the transition portion of the tube. It is important that the tubes should be made using a forming apparatus which is as simple as possible, and which enables them to be made on a large scale quantity production basis.

At the same time it is essential that the transition portion of the tube should be made as short as possible in the axial direction, due to the fact that the cooling fins of the heat exchanger lie only along the bodies of the tubes.

DISCUSSION OF THE INVENTION

A main object of the invention is to provide a heat exchanger tube of the type described above, which is adapted to be made using a tube forming apparatus having a simple structure and which enables the length of the transition portion to be minimized in the axial direction of the tube.

According to the invention in a first aspect, a heat exchanger tube comprising:

- a body of oblong cross section delimited by two major faces and two minor faces;
- an end portion of oblong cross section delimited by two major faces and two minor faces; and
- a transition portion joining the tube body and end portion together, the cross section of the tube body having a length which is greater than the length of the cross section of the end portion, and a width which is less than the width of the cross section of the end portion, is characterised in that the transition portion includes two inclined faces which join together the major faces of the tube body and the major faces of the end portion, together with at least one curved face which joins together, firstly, a minor face of the tube body and a minor face of the end portion, and secondly the two major faces of the tube body.

With this arrangement, the axial length of the transition portion is particularly short, and it can also be made using relatively simple tooling.

In a preferred embodiment of the invention, the two major faces of the body, the two major faces of the end portion, and the two inclined faces of the transition portion are all flat.

Preferably, each of the two inclined faces of the transition portion defines an angle of substantially 30 degrees with respect to the axis of the tube.

In a preferred embodiment of the invention, the tube has a single said curved face joining together a minor face of the tube body and a minor face of the end portion, while the other minor face of the tube body and the other minor face of the end portion have at least one common generatrix. This structure facilitates the arrangement of the tubes in pairs, in which both tubes of any one pair are abutted against each other along the above mentioned generatrices.

Preferably, the curved face of the transition portion is substantially in the form of a portion of a torus, the diameter of which corresponds substantially to the width of the cross section of the body of the tube.

According to another preferred feature of the invention, the curved face in the form of a portion of a torus has a first end portion which is joined end to end with one minor face of the tube body, and another end portion which is joined obliquely to a minor face of the end portion. Preferably in this case, the curved face is joined to the minor face of the end portion at a level in which the cross section of the tube body takes the same form as the cross section of the end portion.

According to the invention in a second aspect, apparatus for forming the end of a heat exchanger tube according to the said first aspect of the invention is characterised in that it includes:

- a first jaw having an open internal cavity, the internal shape of which is homologous with that of one half of the external profile of the body and end portion of the tube, in the region of one of the minor faces of the tube body;
- a second jaw having an open internal cavity, the internal form of which is homologous with that of the other half of the external profile of the body and end portion of the tube in the region of the other minor face of the body; and
- a punch which is displaceable in axial straight line motion within the tube, being maintained between the first jaw and the second jaw as the latter are brought together.

According to a preferred feature of the invention, at least one of the two jaws has a sharp offset between a portion which serves for the configuration of the end portion of the tube and a portion which serves for the configuration of the transition portion, so as to form the curved face of the tube.

According to yet another preferred feature of the invention, the tube forming apparatus includes means for:

bringing the first jaw and the second jaw towards each other in a first displacement in a direction transverse to the axis of the tube, so as to grip the tube without deforming it;

bringing the first jaw and the second jaw further together in a second displacement in the transverse direction so as to begin the deformation of the end portion of the tube;

introducing the punch axially into the partially deformed end portion of the tube held between the first jaw and the second jaw;

bringing the first jaw and the second jaw fully together in a third displacement in the transverse direction, with the punch remaining in position;

withdrawing the punch from the tube; and separating the first jaw and the second jaw from each other.

According to the invention in a third aspect, a heat exchanger is characterised in that it comprises a multiplicity of tubes in accordance with the above mentioned first aspect of the invention, with the respective end portions of the tubes being received in holes in a header plate.

Preferably, the tubes are disposed in pairs in two rows, and the tubes of a pair are abutted against each other, with their respective end portions being received in a common hole in the header plate.

A preferred embodiment of the invention will be described below, by way of example only and with reference to the accompanying drawings.

DESCRIPTION OF A PREFERRED EMBODIMENT OF THE INVENTION

Figure 1:
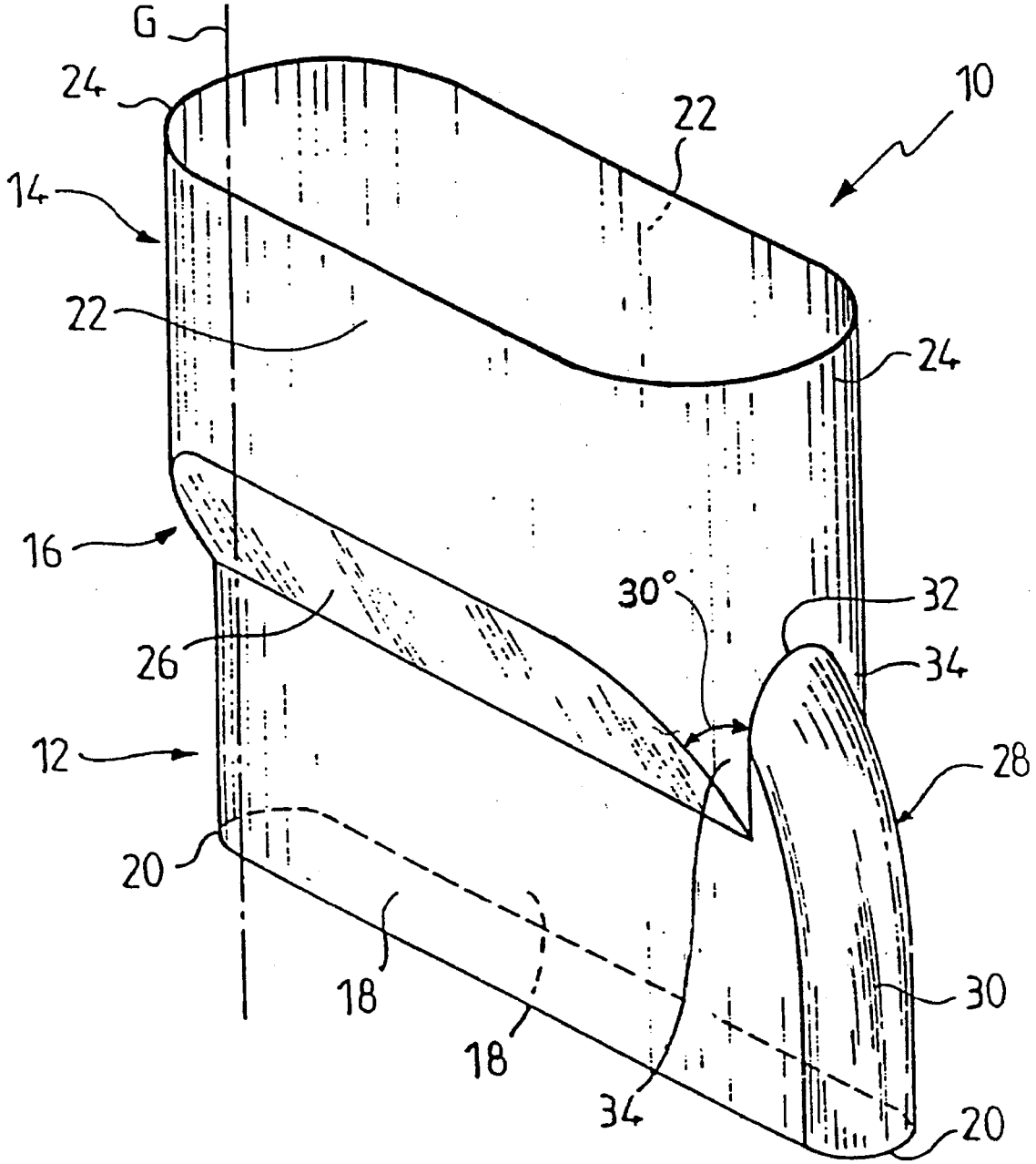
FIG. 1 is a perspective view showing part of a heat exchanger tube in accordance with the invention.

Reference is first made to FIG. 1, which shows a tube 10 for a heat exchanger, in particular a heat exchanger for a motor vehicle. The tube comprises a body 12 (only shown partially), of oblong cross section, an end portion 14, which is again of oblong cross section, and a transition portion 16 which joins the tube body 12 and the end portion 14 together.

Figure 2:
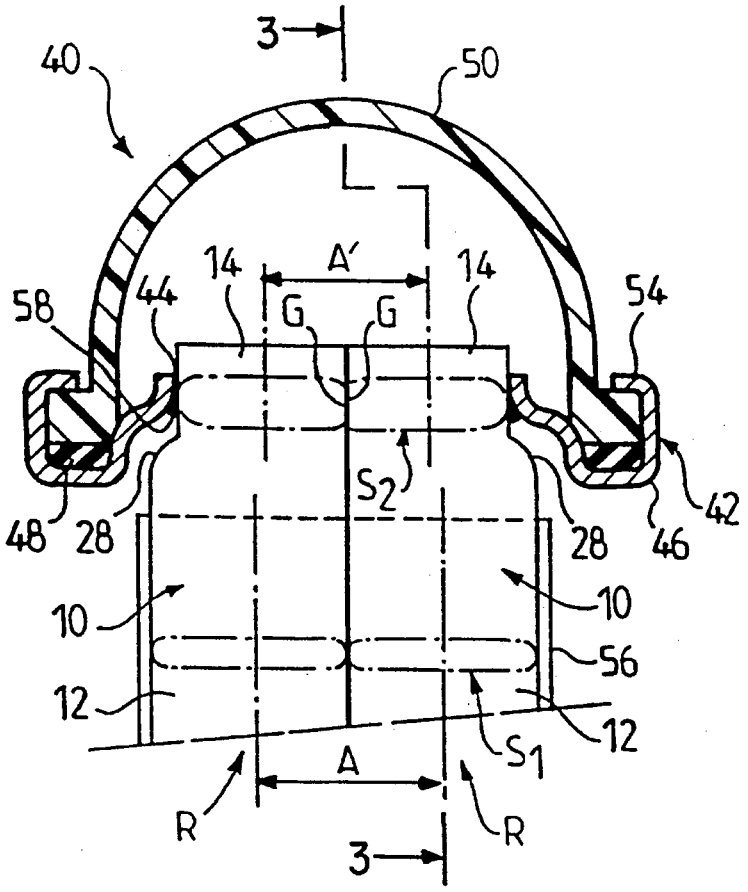
FIG. 2 is a partial view in transverse cross section, of a heat exchanger having tubes similar to that shown in FIG. 1.

The tube body 12 has the oblong cross section indicated at S1 in FIG. 2, and is delimited by two flat major faces 18 and by two rounded minor faces 20 of substantially semicircular form. The end portion 14 has the oblong cross section indicated at S2 in FIG. 2, and is delimited by two flat major faces 22 and two rounded minor faces 24, which are again of substantially semicircular form.

As is best seen in FIG. 1, the cross section S1 of the body 12 has a length, measured between the two minor faces 20 of the body 12, and a width measured between its two major faces 18, which are larger and smaller, respectively, than the length (measured between the minor faces 24), and the width (measured between the major faces 22), of the cross section S2 of the end portion 14. It follows that the end portion 14 has a less oblong form than the body 12, with the perimeter of the end portion 14 being equal to, or slightly less than, that of the body 12.

The minor face 20 and the minor face 24 which lie on the left hand side of FIG. 1 have a common generatrix G, while the minor face 20 and the minor face 24 lying on the right hand side of the same Figure are offset from each other.

As to the transition portion 16, this has two inclined flat faces 26, each of which joins one major face 18 of the tube body 12 to a major face 22 of the end portion. The two inclined faces 16 preferably define an angle of 30 degrees with respect to the axis of the tube, that is to say with respect to the planes of the major faces 18 and 22. In addition, the transition portion 16 has an inwardly curved face 28 which joins together the minor face 20 of the body and the minor face 24 of the end portion lying on the right hand side of FIG. 1. The curved face 28 also joins together the two major faces 18 of the body 12.

In the example shown, the curved face 28 has the form of a portion of a torus, having an end portion 30 which is joined end to end with the associated minor face 20 of the body, and another end portion 32 which is joined obliquely to the associated minor face 24 of the end portion 14. It will be understood that the curved face 28 is joined to the minor face 24 at a level at which the cross section of the body is in the same form as the cross section of the end portion, so that equality between the perimeter of the tube in its body 12 and that in its end portion 14 can be preserved.

It should also be noted that, in the regions 34 which lie between the two inclined faces 26 and the curved portion 28, the tube retains the cylindrical form of the end portion 14.

The tube 10 is preferably made of a metal or a metal alloy, for example aluminium, having good heat transfer properties and being capable of being easily worked.

Figure 3:
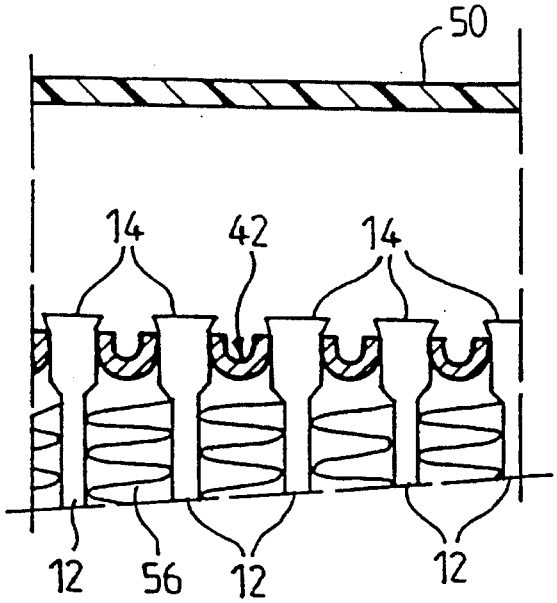
FIG. 3 is a partial view in cross section taken on the line III—III in FIG. 2.

Reference is now made to FIGS. 2 and 3, which show a heat exchanger 40 comprising two rows of tubes 10 arranged in pairs. The two tubes 10 of a pair are abutted together along their respective generatrices G (see FIG. 2). As a result, the pitch A measured between the respective bodies 12 of the two tubes is greater than the corresponding pitch A' between the end portions 14 of the two tubes.

The end portions of the tubes are received in a header plate 42, which has a multiplicity of oblong holes 44 formed through it. The end portions 14 of both tubes of each pair are received in a respective oblong hole 44. The header plate 42 therefore has as many holes 44 as there are pairs of tubes. The general shape of the header plate 42 is rectangular, being bounded by a bent-back edge portion 46 defining a peripheral groove, in which a sealing gasket 48 is fitted.

The heat exchanger 40 also includes a water header wall 50, which has an open side of generally rectangular form, delimited by a flange which is adapted to be introduced into the groove of the header plate 42, so as to compress the gasket 48 under the action of gripping lugs 54 of the header plate.

The heat exchanger 40 further includes interposed fins 56 which are disposed between the pairs of tubes 10. These fins are inserted between the bodies 12 of the tubes up to their transition portions 16, that is to say up to the base of the inclined faces 26 of the latter. Due to the fact that the axial length of the transition portions 16 is very small, the amount of each tube that is not provided with fins is minimized. This enables heat transfer performance of the heat exchanger to be optimized for a given length of the tubes.

In the embodiment shown in FIGS. 2 and 3, the tubes 10 are brazed to the header plate 42, this being indicated by a brazed joint 58. Similarly, the fins 56 are brazed on to the tubes.

Reference is now made to FIGS. 4 to 9, which show tooling of a tube forming apparatus for configuring (forming) a tube of the kind described above. This tooling includes a first jaw 62 which has an open internal cavity 64, the internal shape of which is homologous with that of one half of the external profile of the body and end portion of the tube, in the region of one of the minor faces of the body (in this example that one which lies on the same side as the common generatrix G).

The tooling also has a second jaw 66 which has an open internal cavity 68, the internal shape of which is homologous with that of the other half of the external profile of the body and end portion of the tube, in the region of another minor face of the body (in this example that in which the curved portion 28 of the transition portion 16 is to be formed).

The internal cavity 64 of the first jaw 62 comprises three successive portions 70, 72 and 74, which serve to form the end portion, transition portion and body, respectively, of the tube. Similarly, the internal cavity 68 of the second jaw 66 comprises three successive portions 76, 78 and 80, which again serve to form the end portion, transition portion and body, respectively, of the tube.

The internal cavity 68 of the second jaw 66 defines a sharp offset 82 between its first and second portions 76 and 80. This offset 82 enables the curved portion 28 of the transition portion 16 to be formed.

Figure 4:
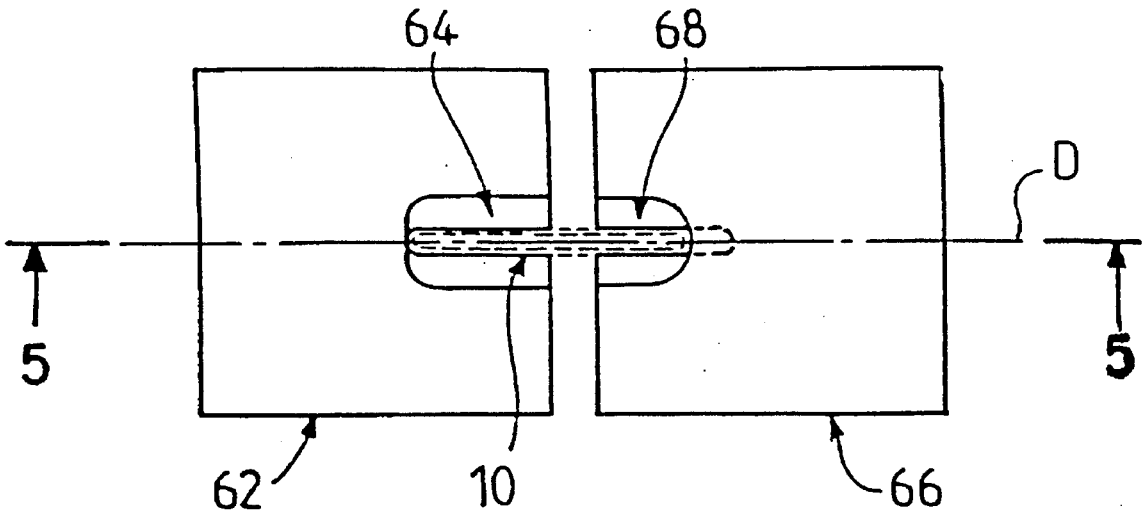
FIG. 4 is a top plan view of the two jaws of a tube forming apparatus in accordance with the invention, in a first position of the jaws.
Figure 5:
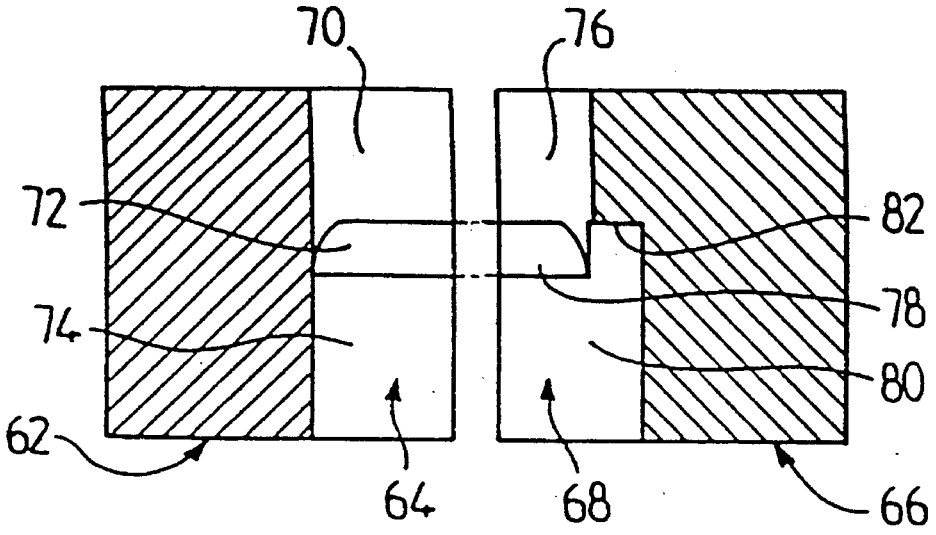
FIG. 5 is a view in cross section taken on the line V—V in FIG. 4.

The jaws 62 and 66 are arranged to be moved towards or away from each other in a direction D which extends transversely to the axis of the tube. Suitable means are provided for effecting this movement, so as to bring the jaws towards each other in a first displacement in the direction D, in order to grip the tube as shown in FIGS. 4 and 5, without at this stage starting to deform the end portion 14 of the tube.

Figure 6:
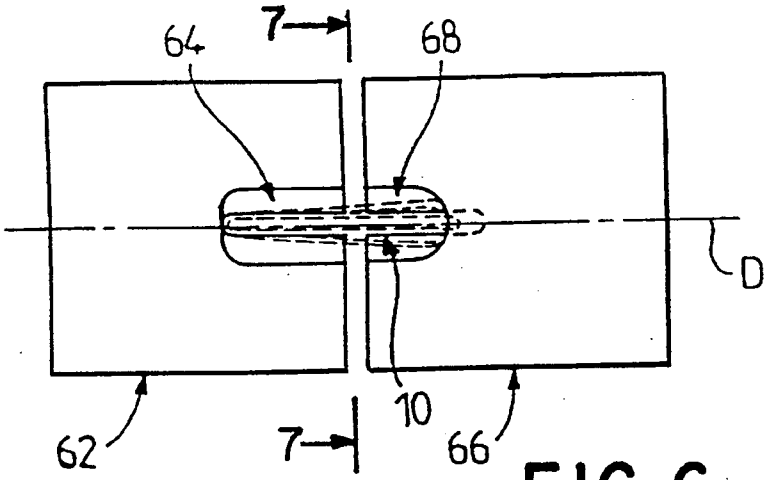
FIG. 6 is a view similar to that in FIG. 4, but in another position of the jaws.

The two jaws are then moved further together in a second displacement, in order to reach the position which is shown in FIG. 6, in which deformation of the end portion 14 is initiated.

Figure 7:
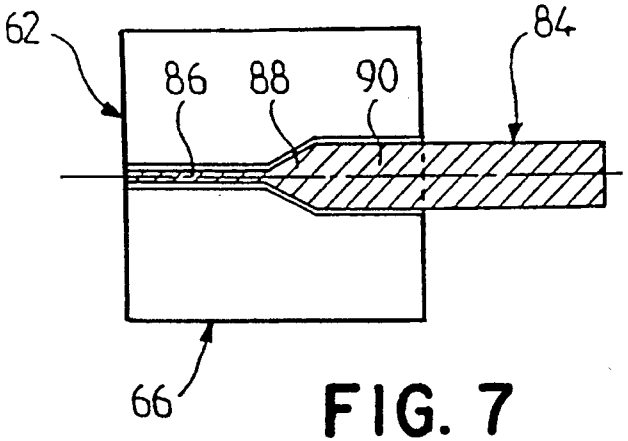
FIG. 7 is a view in cross section taken on the line VII—VII in FIG. 6, with the punch having been introduced into the end of the tube.

As is shown in FIG. 7, a punch 84 is then brought into use. The punch 84 has an end portion 86 which has a shape corresponding to the internal shape of the body 12 of the tube, but with a shorter length of cross section, an intermediate portion 88 which corresponds to the form of the transition portion 16 of the tube, and an opposite end portion 90, the shape of which corresponds to the internal form of the tube end portion 14. The punch 84 is introduced fully into the end portion 14, which causes the latter, and the transition portion 16, to be deformed to their correct shape.

Figure 9:
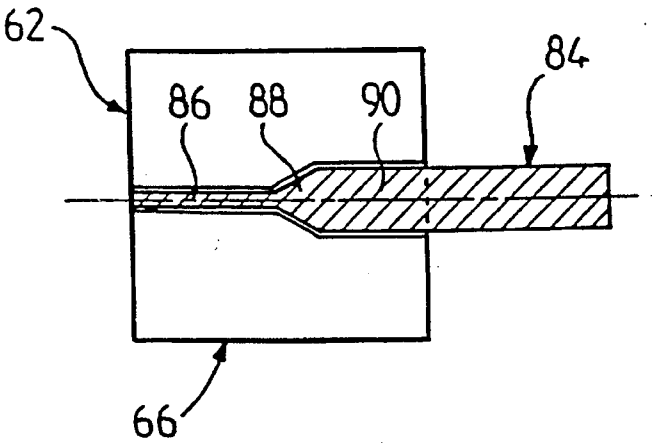
FIG. 9 is a view in cross section taken on the line IX—IX in FIG. 8.
Figure 8:
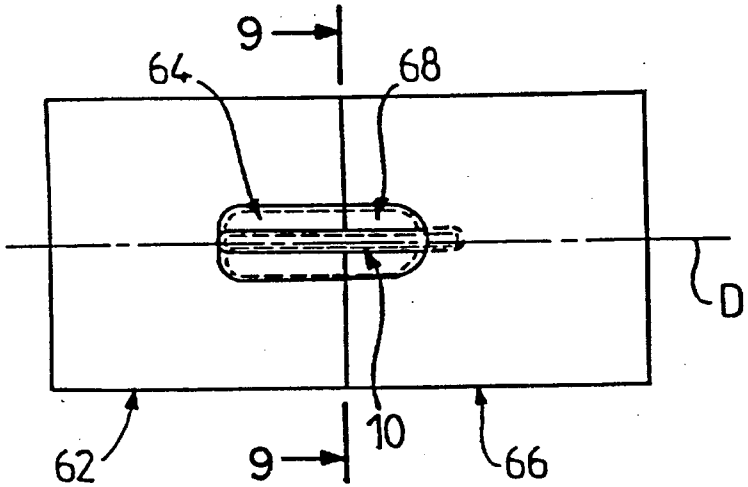
FIG. 8 is a view similar to that in FIG. 6, with the jaws shown in a position in which they are fully together.

The two jaws 62 and 66 are subsequently brought fully together, in order to reach the position shown in FIGS. 8 and 9, with the punch 84 remaining in place. It is then only necessary to withdraw the punch and to separate the two jaws, so that the tube can then be recovered, its end portion having been appropriately deformed.

The apparatus enables the configuration of the tube to be obtained rapidly and under precisely controlled conditions, which are appropriate to high speed production lines.

In practice, the tube is formed, in the manner described above, on both its end portions so that such tubes can subsequently be fitted between the two headers of a heat exchanger.

In addition, it is within the scope of the present invention to form heat exchanger tubes having two curved faces 28, instead of only a single curved face as shown in FIG. 1.

Tubes such as those described above are particularly suitable for use in heat exchangers, and in particular for motor vehicle cooling radiators.

What is claimed is:

1. A heat exchanger tube comprising: a body having two major faces and two minor faces which together define an oblong cross section of the tube body; an end portion having two major faces and two minor faces which together define an oblong cross section of the end portion; and a transition portion joining the tube body to the end portion, the minor faces of the tube body defining a tube body cross section length between them, the major faces of the tube body defining a tube body cross section width between them, the minor faces of the end portion defining an end portion cross section length between them, the major faces of the end portion defining an end portion cross section width between them, the cross section length of the tube body being greater than that of the end portion, and the cross section width of the end portion being greater than that of the tube body, wherein the transition portion includes: two inclined faces each of said inclined faces joining a respective minor face of the body to a minor face of the end portion, with the other minor face of the tube body and the other minor face of the end portion defining at least one common generatrix, each joining together a corresponding respective major face of the tube body to the adjacent major face of the end portion; and at least one curved face joining a minor face of the tube body to a minor face of the end portion, with the curved face also joining together the two major faces of the tube body, the curved face substantially in the form of a portion of a torus having a diameter corresponding substantially to the tube body cross section width, the curved face having a first end portion joined end to end with a minor face of the tube body, and another end portion joined obliquely to a minor face of the end portion, the curved face being joined to the associated minor face of the end portion at a level at which the cross section of the body takes the same form as the cross section of the end portion.

2. A heat exchanger tube according to claim 1, wherein the major faces of the body and end portion, and the inclined faces of the transition portion, are all flat.

3. A heat exchanger tube according to claim 1, the tube further comprising a tube axis, wherein each inclined face defines an angle of 30 degrees with respect to the tube axis.

4. A heat exchanger comprising a header plate having through holes, and a multiplicity of tubes with their end portions received in the holes the tubes each having a body with two major faces and two minor faces which together define an oblong cross section of the tube body; an end portion having two major faces and two minor faces which together define an oblong cross section of the end portion;

and a transition portion joining the tube body to the end portion, the minor faces of the tube body defining a tube body cross section length between them, the major faces of the tube body defining a tube body cross section width between them, the minor faces of the end portion defining an end portion cross section length between them, the major faces of the end portion defining an end portion cross section width between them, the cross section length of the tube body being greater than that of the end portion, and the cross section width of the end portion being greater than that of the tube body, wherein the transition portion includes: two inclined faces, each joining together a corresponding respective major face of the tube body to the adjacent major face of the end portion; at least one curved face joining a minor face of the tube body to a minor face of the end portion, with the curved face also joining together the two major faces of the tube body wherein the tubes are arranged in pairs in two rows, with the tubes of a pair being abutted against each other and with their respective end portions received in a common one of the holes.

* * * * *